US007580653B2

(12) United States Patent
Idehara et al.

(10) Patent No.: US 7,580,653 B2
(45) Date of Patent: Aug. 25, 2009

(54) IMAGE FORMING UNIT AND MOVING UNIT

(75) Inventors: Ryoh Idehara, Hyogo (JP); Nobuhiko Kita, Osaka (JP); Kazuyoshi Kondo, Osaka (JP); Tadashi Okano, Ibaraki (JP); Genta Hagiwara, Ibaraki (JP); Kaoru Tada, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 241 days.

(21) Appl. No.: 11/623,477

(22) Filed: Jan. 16, 2007

(65) Prior Publication Data

US 2007/0166073 A1 Jul. 19, 2007

(30) Foreign Application Priority Data

Jan. 17, 2006 (JP) ..... 2006-008716

(51) Int. Cl.
*G03G 15/00* (2006.01)
*G03G 15/04* (2006.01)

(52) U.S. Cl. ..... 399/110; 399/118; 399/205

(58) Field of Classification Search ..... 399/110, 399/118, 205, 213
See application file for complete search history.

(56) References Cited

U.S. PATENT DOCUMENTS

2007/0166073 A1 7/2007 Idehara et al.

FOREIGN PATENT DOCUMENTS

| | | |
|---|---|---|
| JP | 4-243268 | 8/1992 |
| JP | 7-209943 | 8/1995 |
| JP | 2849978 | 11/1998 |
| JP | 3153103 | 1/2001 |
| JP | 2001-175046 | 6/2001 |
| JP | 2004-77799 | 3/2004 |
| JP | 2005-91792 | 4/2005 |

OTHER PUBLICATIONS

U.S. Appl. No. 11/552,277, filed Oct. 24, 2006, Idehara, et al.
U.S. Appl. No. 11/560,632, filed Nov. 16, 2006, Kondo, et al.
U.S. Appl. No. 11/623,477, filed Jan. 16, 2007, Idehara, et al.
U.S. Appl. No. 11/758,973, filed Jun. 6, 2007, Kita, et al.
U.S. Appl. No. 12/118,989, filed May 12, 2008, Furuichi, et al.

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a cover frame that holds a held shaft of an optical writing unit to allow a free movement thereof and urges the optical writing unit in a predetermined direction by using an urging coil spring to bring the held portion shaft of the optical writing unit separated from the writing operation position into contact with a contact target portion thereof.

11 Claims, 10 Drawing Sheets

IMAGE FORMING UNIT AND MOVING UNIT

CROSS-REFERENCE TO RELATED APPLICATIONS

The present document incorporates by reference the entire contents of Japanese priority document, 2006-008716 filed in Japan on Jan. 17, 2006.

BACKGROUND OF THE INVENTION

1. Field of the Invention

The present invention relates to an imaging forming apparatus including a latent image carrier that carries a latent image on an endless moving surface and a latent-image writing unit that moves between an operating position and a retracting position. The present invention also relates to a moving unit used in the image forming apparatus.

2. Description of the Related Art

A typical electrophotographic image forming apparatus extensively adopts a structure that uses a latent-image writing unit, e.g., a laser writing device, that performs optical scanning utilizing a laser beam to write a latent image on a latent image carrier, such as a uniformly charged photoconductor. The latent-image writing unit makes difficult the maintenance of the latent image carrier or a peripheral device, such as a developing device, arranged around the latent image carrier.

Japanese Patent No. 2849978 discloses an image forming apparatus having a structure in which an opening/closing cover that can be opened/closed with respect to a fixed cover as a part of a housing of the image forming apparatus supports a latent-image writing unit, and the latent-image writing unit is considerably separated from a latent image carrier when the opening/closing cover is opened. When the opening/closing cover is opened, the latent-image writing unit is retracted from a position where it faces the latent image carrier and the latent image carrier or its peripheral device is exposed to the outside, thereby making the maintenance of these members easy.

However, in the image forming apparatus disclosed in Japanese Patent No. 849978, an error occurs in a relative position between the latent-image writing unit, which is supported by the opening/closing cover, and the latent image carrier, which is supported by the fixed cover. One reason for the occurrence of the error is jouncing of the opening/closing cover with respect to the fixed cover. Such an error lowers the accuracy of positioning in a writing operation of the latent-image writing unit. The same problem can occur due to a backlash of the latent-image writing unit even in a structure of moving the latent-image writing unit alone or together with any member rather than moving the latent-image writing unit when the opening/closing cover is opened/closed.

The present inventors are developing an image forming apparatus that positions the latent-image writing unit therein. This image forming apparatus uses a spring to urge the latent-image writing unit in a predetermined direction while holding the latent-image writing unit to allow its free movement by using the opening/closing cover. When the opening/closing cover is closed, the latent-image writing unit is urged toward a positioning portion in an image forming apparatus main body to bring a positioning reference region of the latent-image writing unit into contact with the positioning portion of the image forming apparatus main body. This contact allows the latent-image writing unit to be positioned with respect to the image forming apparatus main body, thereby suppressing a reduction in writing position accuracy due to a backlash of the opening/closing cover. However, in this structure, the latent-image writing unit that is not in contact with the positioning portion in the image forming apparatus main body may be swiftly jounced and damaged within a free movement range in the opening/closing cover due to a back action when the opening/closing cover is opened or closed.

SUMMARY OF THE INVENTION

It is an object of the present invention to at least partially solve the problems in the conventional technology.

According to an aspect of the present invention, an image forming apparatus includes a latent image carrier that carries a latent image on an endlessly moving surface; a latent-image writing unit that writes the latent image on the surface; a holder that moves between a first position and a second position while holding the latent-image writing unit to move the latent-image writing unit held by itself between a writing operation position and a retracted position; and a developing unit that develops the latent image carried by the latent image carrier, wherein the holder holds a held portion provided in the latent-image writing unit to allow a free movement thereof and urges the latent-image writing unit in a predetermined direction by an urging unit, thereby bringing the held portion in the latent-image writing unit into contact with a contact target portion of the holder when separated from the writing operation position.

According to another aspect of the present invention, a moving unit for use in an image forming apparatus includes a latent image carrier that carries a latent image on an endlessly moving surface; a latent-image writing unit that writes the latent image on the surface; and a holder that moves between a first position and a second position while holding the latent-image writing unit to move the latent-image writing unit held by itself between a writing operation position and a retracted position, wherein the holder holds a held portion provided in the latent-image writing unit to allow a free movement thereof and urges the latent-image writing unit in a predetermined direction by an urging unit, thereby bringing the held portion in the latent-image writing unit into contact with a contact target portion of the holder when separated from the writing operation position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an electrophotographic printer (hereinafter, "printer") will be explained as an image forming apparatus to which the present invention is applied.

Figure 1:
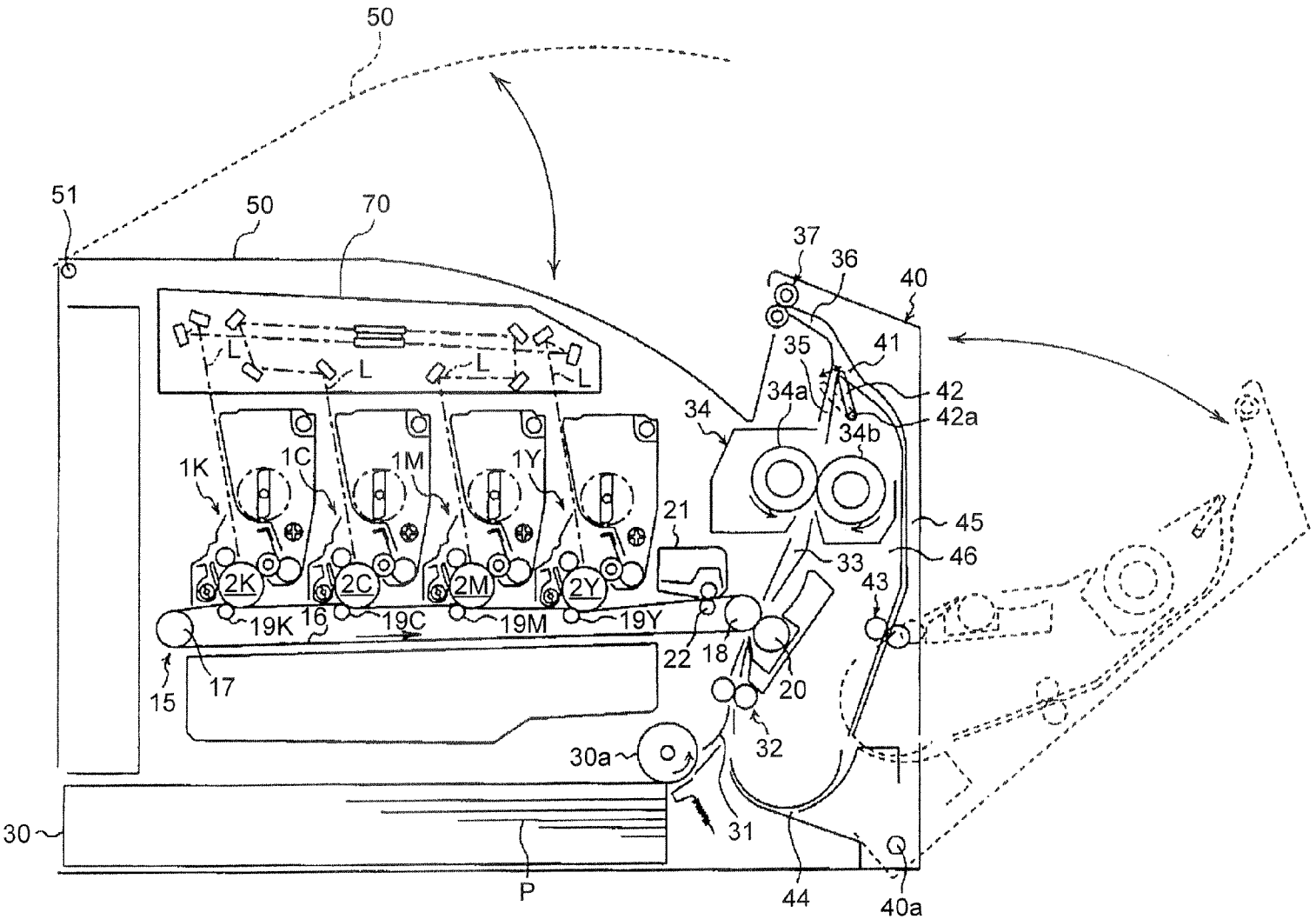
FIG. 1 is a schematic side view of a printer according to an embodiment of the present invention.
Figure 2:
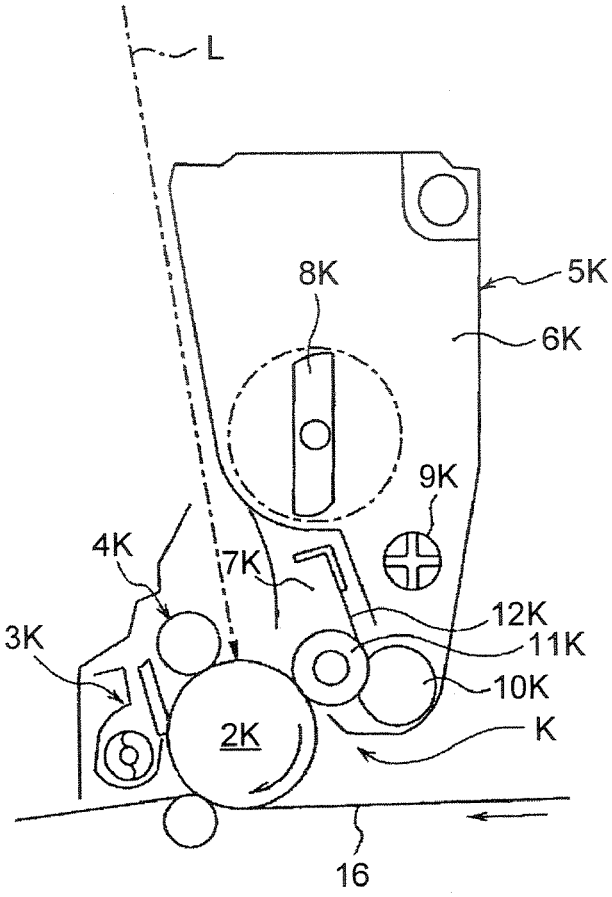
FIG. 2 is an enlarged view of a K process unit in the printer.

FIG. 1 is a schematic side view of the printer. The printer includes four process units 1Y, 1M, 1C, and 1K that form toner images of yellow (Y), magenta (M), cyan (C), and black (K). The structure of the four process units 1Y, 1M, 1C, and 1K is almost the same except that they use Y, M, C and K toners, i.e., toners of different colors. Therefore, the structure of the process unit 1K that forms a K toner image will be explained below as an example. As shown in FIG. 2, the process unit 1K includes a drum-like photoconductor 2K as a latent image carrier, a drum cleaner 3K, a decharging device (not shown), a charging device 4K, a developing device 5K as a developing unit. The process unit 1K, which is an image forming unit, is detachably attached to a main body of the printer, and its consumable parts can be replaced at a time.

A driving unit (not shown) rotates the photoconductor 2K in clockwise direction. The charging device 4K uniformly charges a surface of the photoconductor 2K while the photoconductor 2K rotates. The uniformly charged surface of the photoconductor 2K is subjected to exposure scanning using a laser beam L to carry a K electrostatic latent image thereon. The developing device 5K develops the electrostatic latent image for K into a K toner image. Then, this image is intermediate-transferred onto a intermediate transfer belt 16. The drum cleaner 3K removes residual toner adhering to the surface of the photoconductor 2K after the intermediate transfer process. The decharging device decharges residual charge on the photoconductor 2K after cleaning. The surface of the photoconductor 2K is initialized and prepared for the nest image formation due to the decharging. In the process units of other colors (1Y, 1M, and 1C), (Y, M, and C) toner images are likewise formed on the photoconductors (2Y, 2M, and 2C) and intermediate-transferred onto the intermediate transfer belt 16.

The developing device 5K has a vertically long hopper section 6K that accommodates the K toner (not shown), and a developing unit 7K. In the hopper section 6K are arranged an agitator 8K that is driven to rotate by a driving unit (not shown), a stirring paddle 9K that is driven to rotate by the driving unit below the agitator 8K in the vertical directions a toner supply roller 10K that is driven to rotate by the driving unit in the vertical direction with respect to the stirring paddle 9K. The K toner in the hopper section 6K moves toward the toner supply roller 10K by its own weight while being mixed by a rotating and driving motion of the agitator 8K or the stirring paddle 9K. The toner supply roller 10K has a metallic core and a roller section formed of resin foam applied to a surface of this core, and rotates while attaching the K toner in the hopper section 6K to the surface of the roller section.

A developing roller 11K that rotates while in physical contact with the photoconductor 2K or the toner supply roller 10K, a thinned blade 12K having a distal end coming into contact with a surface of the developing roller 11K, and others are arranged in the developing unit 7K of the developing device 5K. The K toner adhering to the toner supply roller 10K in the hopper section 6K is supplied to the surface of the developing roller 11K at a contact portion between the developing roller 11K and the toner supply roller 10K. When the supplied K toner passes through a contact position between the roller and the thinned blade 12K with rotation of the developing roller 11K, a layer thickness of the K toner is restricted on the roller surface. The K toner subjected to layer thickness restriction adheres to a K electrostatic latent image on the surface of the photoconductor 2K in a developing region as the contact portion between the developing roller 11K and the photoconductor 2K. Due to the adhesion of the K toner to the photoconductor 2K, the K electrostatic latent image is developed into a K toner image.

Although the K process unit is explained above with reference to FIG. 2, the same or similar process enables formation of Y, M, and C toner images on the surfaces of the photoconductors 2Y, 2M, and 2C in the process units 1Y, 1M, and 1C for Y, M, and C colors.

As shown in FIG. 1, an optical writing unit 70 is arranged above the process units 1Y, 1M, 1C, and 1K in the vertical direction. The optical writing unit 70 as a latent-image writing unit uses a laser beam L emitted from a laser diode based on image information to optically scan the photoconductors 2Y, 2M, 2C, and 2K in the process units 1Y, 1M, 1C, and 1K. This optical scanning allows electrostatic latent images for Y, M, C, and K to be formed on the photoconductors 2Y, 2M, 2C, and 2K. It is to be noted that the optical writing unit 70 irradiates the photoconductors with the laser beam (L) emitted from a light source through a plurality of optical lenses or mirrors while polarizing this beam in a main scanning direction by using a polygon mirror driven to rotate by a polygon motor (not shown).

A transfer unit 15 that endlessly moves the endless intermediate transfer belt 16 in a counterclockwise direction in the drawing while stretching this belt is arranged below the process units 1Y, 1M, 1C, and 1K in the vertical direction. The transfer unit 15 as a transferring unit includes a driving roller 17, a driven roller 18, four primary transfer rollers 19Y, 19M, 19C, and 19K, a secondary transfer roller 20, a belt cleaner 21, a cleaning backup roller 22 and others as well as the intermediate transfer belt 16.

The intermediate transfer belt 16 is stretched by the driving roller 17, the driven roller 18, the cleaning backup roller 22, and the four primary transfer rollers 19Y, 19M, 19C, and 19K arranged in a loop thereof. A rotating force of the driving roller 17 that is driven to rotate in the counterclockwise direction in the drawing by a driving unit (not shown) allows the intermediate transfer belt 16 to endlessly move in the same direction.

The four primary transfer rollers 19Y, 19M, 19C, and 19K sandwich the intermediate transfer belt 16 that is endlessly moved in this manner between themselves and the photoconductors 2Y, 2M, 2C, and 2K. This sandwich structure forms primary transfer nips for Y, M, C, and K that allow a front surface of the intermediate transfer belt 16 to come into contact with the photoconductors 2Y, 2M, 2C, and 2K.

A transfer bias power supply (not shown) applies a primary transfer bias to the primary transfer rollers 19Y, 19M, 19C, and 19K, thereby forming a transfer electric field between electrostatic latent images of the photoconductors 2Y, 2M, 2C, and 2K and the primary transfer rollers 19Y, 19M, 19C, and 19K. It is to be noted that transfer chargers or transfer brushes may be adopted in place of the primary transfer rollers 19Y, 19M, 19C, and 19K.

When the Y toner formed on a surface of the photoconductor 2Y in the Y process Unit 1Y enters the Y primary transfer nip with rotation of the photoconductor 2Y, a function of the transfer electric field or a nip pressure realizes primary transfer of the Y toner onto the intermediate transfer belt 16 from the photoconductor 2Y. When the intermediate transfer belt 16 having the Y toner primary-transferred thereon passes through the primary transfer nips for M, C, and K with the endless movement thereof, M, C, and K toner images on the photoconductors 2M, 2C, and 2K are sequentially superimposed and primary-transferred onto Y toner image. This primary transfer based on superimposition allows forming a toner image having four colors on the intermediate transfer belt 16.

The secondary transfer roller 20 of the transfer unit 15 is arranged outside the loop of the intermediate transfer belt 16, and sandwiches the intermediate transfer belt 16 between itself and the driven roller 18 in a loop thereof. This sandwich structure forms a secondary transfer nip that allows the front surface of the intermediate transfer belt 16 to come into contact with the secondary transfer roller 20. The transfer bias power supply applies a secondary transfer bias to the secondary transfer roller 20. This application forms a secondary transfer electric field between the secondary transfer roller 20 and the driven roller that is connected with the earth.

A paper feed cassette 30 that accommodates a plurality of recording paper sheets P superimposed in a bundled state is arranged below the transfer unit 15 in the vertical direction in such a manner that it can be slidably attached to/detached from to the housing of the printer. The paper feed cassette 30 has a paper feed roller 30*a* that is in contact with the uppermost recording paper sheet P in the paper bundle. When the paper feed roller 30*a* is rotated in the counterclockwise direction in the drawing at a predetermined timing, this recording paper sheet P is fed toward a paper feed path 31.

A resist roller pair 32 is arranged near a distal end of the paper feed path 31. When the resist roller pair 32 sandwiches the recording paper sheet P fed from the power feed cassette 30 between rollers thereof, it immediately stops rotation of both the rollers. Then, the rotational driving is restarted at a timing of synchronizing the sandwiched recording paper sheet P with the four-color toner image on the intermediate transfer belt 16 in the secondary transfer nip, and the recording paper sheet P is supplied toward the secondary transfer nip.

The four-color toner image on the intermediate transfer belt 16 pressed against the recording paper sheet P in the secondary transfer nip is collectively subjected to secondary transfer onto the recording paper sheet P under the influence of a secondary transfer electric field or a nip pressure, and coupled with a white color of the recording paper sheet P to become a full-color toner image. When the recording paper sheet P having the full-color toner image formed on a surface thereof in this manner passes through the secondary transfer nip, it is self-stripped from the secondary transfer roller 20 or the intermediate transfer belt 16. Then, the recording paper sheet P is supplied to a fixing device 34 through a post-transfer carriage path 33.

The residual toner that is not transferred onto the recording paper sheet P adheres to the intermediate transfer belt 16 after passing through the secondary transfer nip. The belt cleaner 21 that is in contact with the front surface of the intermediate transfer belt 16 cleans this residual toner from the belt surface. The cleaning backup roller 22 arranged in the loop of the intermediate transfer belt 16 backs up belt cleaning performed by the belt cleaner 21 from the inside of the loop.

The fixing device 34 uses a fixing roller 34*a* that includes a heat source (not shown), such as a halogen lamp, and a pressure applying roller 34*b* that rotates while coming into contact with the fixing roller 34*a* with a predetermined pressure to form a fixing nip. The recording paper sheet P fed into the fixing device 34 is held in the fixing nip with its unfixed toner image carrying surface being pressed against the fixing roller 34*a*. The toner in the toner image is softened under the influence of heating or pressure application, thereby fixing the full-color image.

The recording paper sheet P ejected from the inside of the fixing device 34 reaches a diverging point between a paper ejection path 36 and a pre-reversal carriage path 41 after passing through a post-fixation carriage path 35. A switching claw 42 that is driven to swivel around a swiveling shaft 42*a* is arranged on a side of the post-fixation carriage path 35, and its swiveling motion closes or opens a part near a distal end of the post-fixation carriage path 35. At a timing of feeding the recording paper sheet P from the fixing device 34, the switching claw 42 stops at a swiveling position indicated by a solid line in the drawing to open a part near the distal end of the post-fixation carriage path 35. Therefore, the recording paper sheet P enters the paper ejection path 36 from the post-fixation carriage path 35 to be sandwiched between rollers of a paper ejecting roller pair 37.

When a single-sided print mode is set based on an input operation with respect to an operating unit formed of, e.g., a numeric keyboard (not shown) or a control signal supplied from, e.g., a personal computer (not shown), the recording paper sheet P sandwiched in the paper ejecting roller pair 37 is ejected to the outside of the apparatus as it is. Then, the recording paper sheet P is stacked in a stacking unit that is an upper surface of an upper cover 50 of the housing.

On the other hand, if a double-sided print mode is set, a rear end side of the recording paper sheet P carried in the paper ejection path 36 while being held in the paper ejecting roller pair 37 on a distal end side thereof passes through the post-fixation carriage path 35, the switching claw 42 swivels to a position indicated by an alternate long and short dash line in the drawing, thereby closing a part close to the distal end of the post-fixation carriage path 35. The paper ejecting roller pair 37 starts reverse rotation substantially simultaneously with this closing. Then, the recording paper sheet P is carried with its rear end side facing a top side, and enters the pre-reversal carriage path 41.

FIG. 1 is a view of a front side of this printer. A front side in a direction perpendicular to a page space of the drawing corresponds to a front surface of the printer, and an inner side corresponds to a rear surface. A right side in the drawing corresponds to a right side surface of the printer, and a left side in the drawing corresponds to a left side surface of the same. A right end of the printer serves as a reversing unit 40 that can be opened/closed with respect to a housing main body when swiveling around a swiveling shaft 40*a*. When the paper ejecting roller pair 37 rotates in a reverse direction, the recording paper sheet P enters the pre-reversal carriage path 41 of the reversing unit 40 and is carried downwards from an upper side in the vertical direction. Then, the recording paper sheet P enters a reversal carriage path 44 curved in a semicircular shape after passing through a space between the rollers in a reversal carriage roller pair 43. When the recording paper sheet P is carried along the curved shape, a downward traveling direction of the recording paper sheet P from the upper side in the vertical direction is reversed while upper and lower surfaces of the recording paper sheets P are reversed, and the recording paper sheet P is carried upwards from a lower side in the vertical direction. Subsequently, the recording paper sheet P reenters the secondary transfer nip through the paper feed path 31. The full-color image is subjected to collective secondary transfer onto the other surface, and then the recording paper sheet P sequentially passes through the post-transfer carriage path 33, the fixing device 34, the post-fixation carriage path 35, the paper ejection path 36 and the paper ejecting roller pair 31 to be ejected to the outside of the apparatus.

The reversing unit 40 has an external cover 45 and an oscillator 46. Specifically, the external cover 45 of the reversing unit 40 is supported to swivel around the swiveling shaft 40*a* provided to the housing of the printer main body. This swiveling motion allows the external cover 45 to be opened/closed with respect to the housing together with the oscillator 46 held in the external cover 45. As indicated by a dotted line in the drawing, when the external cover 45 is opened together with the oscillator 46 held therein, the paper feed path 31, the secondary transfer nip, the post-transfer carriage path 33, the fixing nip, the post-fixation carriage path 35, and the paper ejection path 36 formed between the reversing unit 40 and the printer main body side are divided into two in the vertical direction to be exposed to the outside. As a result, a jammed paper sheet in the paper feed path 31, the secondary transfer nip, the post-transfer carriage path 33, the fixing nip, the post-transfer carriage path 35, and the paper ejection path 36 can be readily removed.

The oscillator 46 is supported by the external cover 45 to swivel around an oscillating shaft (not shown) provided to the external cover 45 when the external cover 45 is opened. This swiveling motion allows the pre-reversal carriage path 41 or the reversal carriage path 44 is divided into two in the vertical direction to be exposed to the outside when the oscillator 46 is opened with respect to the external cover 45. As a result, a jammed paper sheet in the pre-reversal carriage path 41 or the reversal carriage path 44 can be readily removed.

As indicated by an arrow in the drawing, the upper cover 50 of the housing in the printer is supported to allow its swiveling motion around a shaft member 51 without restraint. The upper cover 50 is opened with respect to the housing when rotating in the counterclockwise direction in the drawing. Further, it largely exposes an upper opening of the housing.

Figure 3:
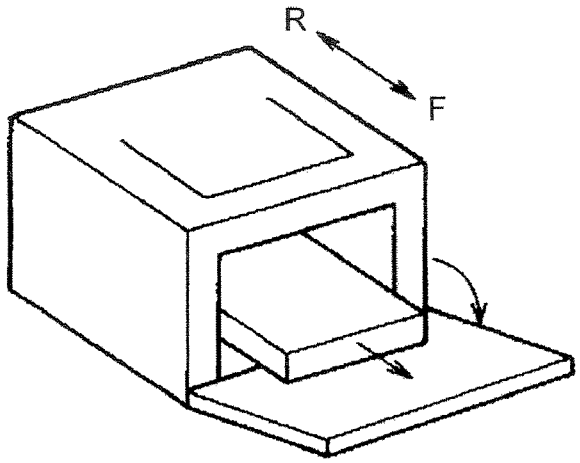
FIG. 3 is a perspective view of an example of an image forming apparatus that performs internal maintenance in a front-cover opening/closing mode.
Figure 4:
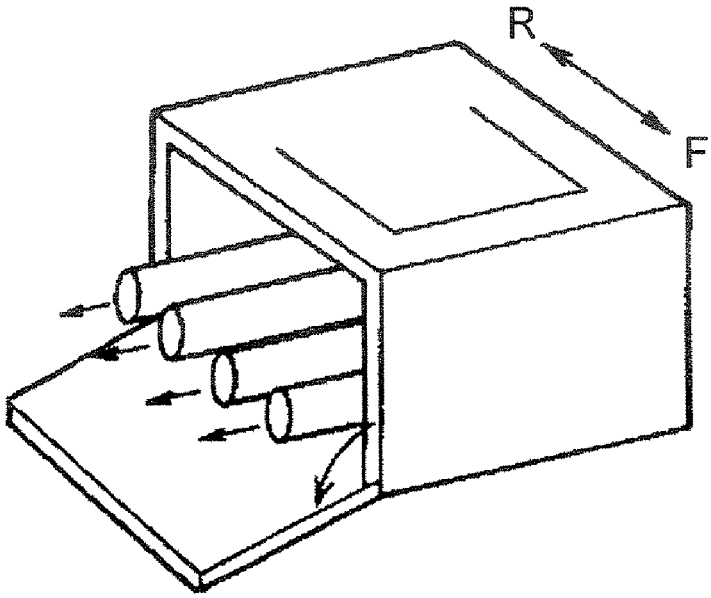
FIG. 4 is a perspective view of an example of the image forming apparatus that carries out internal maintenance in a left-cover opening/closing mode.
Figure 5:
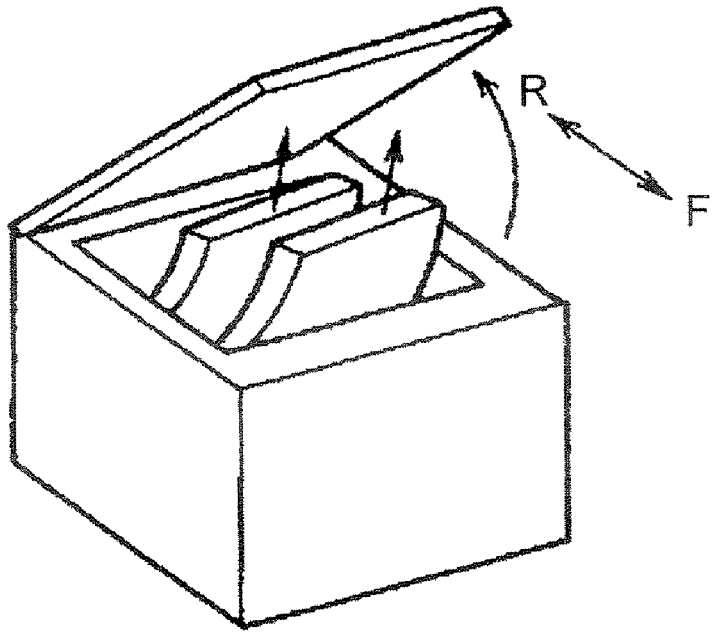
FIG. 5 is a perspective view of an example of the image forming apparatus that performs internal maintenance in an upper-cover opening/closing mode.

Meanwhile, in a recent image forming apparatus, achieving attachment/detachment of its internal components or devices is demanded without deteriorating a reduction in size or weight, or operability of the image forming apparatus. As a method of attaching/detaching components or devices, a method of opening a front cover provided at a front end (an end in a direction indicated by an arrow F in the drawing) of the housing of the image forming apparatus to achieve attachment/detachment as shown in FIG. 3 or a method of opening a left cover provided at a left end of the housing to attain attachment/detachment as depicted in FIG. 4 can be considered. A method of opening the upper cover 50 provided at an upper end of the housing to realize attachment/detachment as shown in FIG. 5 can be also considered. Concerning components or devices that are relatively frequently attached/detached, adopting the method of opening the upper cover 50 to achieve attachment/detachment as shown in FIG. 5 is desirable. That is because a user does not have to take an uncomfortable posture, e.g., squatting, bending down, or bowing, and confirming an attaching/detaching operation while watching the inside of the housing from the upper side can reduce a work burden or suppress occurrence of an operation error. It is often the case that the upper portion of the image forming apparatus is utilized as a paper ejection tray, or a scanner is mounted on this upper portion. A fact that this upper portion tends to become a position with excellent visibility is one of reasons why adopting FIG. 5 method is desirable.

In the printer according to this embodiment, the four process units 1Y, 1M, 1C, and 1K depicted in FIG. 1 are typical examples of a device having a relatively high attachment/detachment frequency. That is because these units are replaced when the toner is used up. Examining a structure that attaches/detaches these process units 1Y, 1M, 1C, and 1K based on such an upper cover opening method as shown in FIG. 5, the most important layout condition of the respective process units 1Y, 1M, 1C, and 1K is arranging these units in the horizontal direction. When these units are aligned in the vertical direction rather than the horizontal direction, for example, not only the third unit from the top that needs to be replaced as well as the first and the second units that do not have to be replaced must be attached/detached to replace the third unit, thereby considerably deteriorating operability.

For this reason, when the horizontal layout is adopted with respect to the four process units 1Y, 1M, 1C, and 1K, it is desirable to stretch the intermediate transfer belt 16 in a horizontally long posture as shown in FIG. 1 in such a manner that this belt comes into contact with the respective horizontally aligned photoconductors 2Y, M, C and K. Then, the four horizontally aligned process units 1Y, 1M, 1C, and 1K are arranged above the intermediate transfer belt 16 in the vertical direction, the intermediate transfer belt 16 having the horizontally long posture as shown in FIG. 1. Alternatively, these units are arranged below the intermediate transfer belt 16 contrary to the layout depicted in FIG. 1. When these units are arranged below the intermediate transfer belt 16, the optical writing unit 70 must be arranged below the respective process units in a horizontally long posture to allow optical scanning with respect to the four photoconductors 2Y, 2M, 2C, and 2K. Contrary to the layout depicted in FIG. 1, this is a layout in which the optical writing unit 70, the respective process units (1Y to 1K), and the intermediate transfer belt 16 are sequentially superimposed upwards from the lower side in the vertical direction. However, in a structure where the recording paper sheet P is carried toward the upper side from the lower side in the vertical direction, the fixing device 34 must be provided above the intermediate transfer belt 16 forming the secondary transfer nip. Therefore, when the layout is adopted, the left side of the fixing device 34 in the drawing becomes a blank space. Therefore, a reduction in size or space of the apparatus becomes difficult.

Thus, as shown in FIG. 1, the printer according to this embodiment adopts the layout in which the four process units 1Y, 1M, 1C, and 1K are aligned in the horizontal direction and arranged above the intermediate transfer belt 16 having the horizontally long posture. In this layout, as shown in the drawing, the optical writing unit 70 having the horizontally long posture is arranged above the four process units 1Y, 1M, 1C, and 1K. The four process units 1Y, 1M, 1C, and 1K or the optical writing unit 70 are arranged on a lateral side of the fixing device 34 as shown in the drawing, thereby avoiding occurrence of the blank space.

In any layout where the horizontally aligned respective process units are arranged above or below the intermediate transfer belt 16 having the horizontally long posture, the optical writing unit 70 or the intermediate transfer belt 16 must be retracted from a position where it faces each process unit prior to performing the attaching/detaching operation with respect to each process unit. For example, like this printer, when each process unit is arranged above the intermediate transfer belt 16, the optical writing unit 70 is arranged above the respective process units (1Y to 1K) as shown in FIG. 1. In such a layout, even if the upper cover 50 is opened with respect to the housing main body, the optical writing unit 70 becomes an obstacle, and hence the respective process units immediately below the optical writing unit 70 cannot be exposed. Therefore, before performing the attaching/detaching operation with respect to the respective process units, the optical writing unit 70 must be retracted from a position immediately above the respective process units As different from the structure shown in FIG. 1, when the respective process units are arranged below the intermediate transfer belt 16, intermediate transfer belt 16 is placed immediately above the respective process units. Therefore, prior to attaching/detaching the respective process units, the intermediate transfer belt 16 must be retracted from the position directly above the respective process units.

In this printer, since the respective process units are arranged above the intermediate transfer belt 16 and the optical writing unit 70 is further arranged above the intermediate transfer belt 16 in terms of a reduction in size or space as explained above, the optical writing unit 70 is retracted from the position directly above the respective process units. In the method of opening the upper cover 50 like this printer, the following structure can be considered as the structure of retracting the optical writing unit 70. That is, the optical writing unit 70 is supported by, e.g., a frame in the housing to allow its sliding movement in the vertical direction so that the optical writing unit 70 is attached/detached in the vertical direction. Furthermore, one end side of the optical writing unit 70 may be supported by, e.g., a frame in the housing to allow its swiveling motion, and the optical writing unit 70 may be swiveled like a opening/closing door to be retracted from the position directly above the respective process units or set immediately above these units. Moreover, the optical writing unit 70 may be held on a lower surface side of the upper cover 50 that can be opened/closed, and the optical writing unit 70 may be retracted from the position directly above the respective process units or set immediately above these units at the timing of opening/closing the upper cover 50.

However, in any structure, an error occurs in a relative position between the optical writing unit 70 and the respective photoconductors 2Y, 2M, 2C, and 2K in the housing due to a backlash of the optical writing unit 70 that can slide or swivel or a backlash of the upper cover 50. This error deteriorates a writing position accuracy of the optical writing unit 70. A reduction in the writing position accuracy becomes a factor of image blurring, absence of an image, vignetting, and others. In a structure where a plurality of process units are arranged like this printer, color matching displacement occurs.

A characteristic structure of this printer will now be explained.

Figure 6:
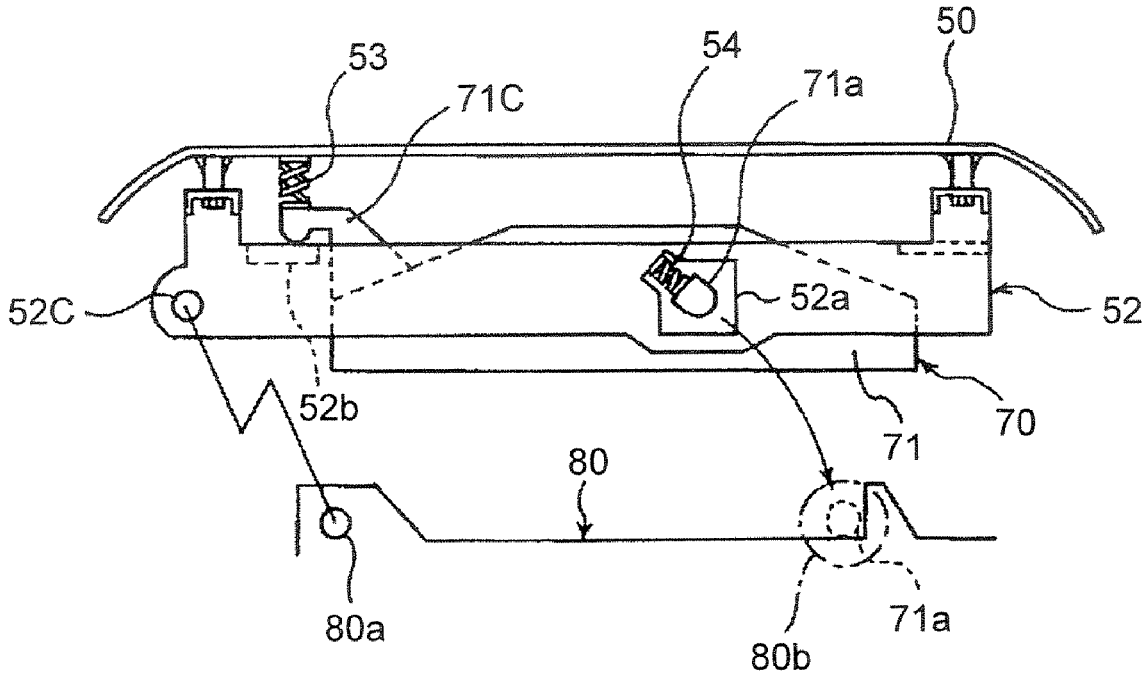
FIG. 6 is an enlarged view of an upper cover and its peripheral structure in the printer.

FIG. 6 is an enlarged view of the upper cover 50 and its peripheral structure in this printer. As shown in this drawing, a cover frame 52 as a holder is fixed on a rear surface of the upper cover 50, and this holds the optical writing unit 70 as a latent-image writing unit. In more detail, the cover frame 52 has a front plate and a rear plate 52*e* (see FIG. 19) that face each other with a predetermined distance therebetween in a front-and-back direction of the printer (a direction perpendicular to a page space of the drawing), and a rib (not shown) that couples these plates with each other. The front plate and the rear plate have rectangular through openings 52*a* formed at a position where these plates face each other. On the other hand, the optical writing unit 70 has a cylindrical first front-held shaft 71*a* protruding at a positioning reference position of the front plate in a casing 71 thereof. Although not depicted in the drawing, the optical writing unit 70 also has a cylindrical first rear-held shaft protruding at a positioning reference position of the rear plate in the casing 71. These held shafts are provided to extend in the same axis line. The optical writing unit 70 is placed between the front plate and the rear plate 52*e* of the cover frame 52. The first front-held shaft 71*a* protruding on the front plate in the casing 71 pierces through the through opening 52*a* provided in the front plate of the cover frame 52. Although not depicted in the drawing, the first rear-held shaft protruding on the rear plate in the casing 71 pierces through the through opening provided in the rear plate 52*e* of the cover frame 52. The optical writing unit 70 further has a hook portion 71*c* on an upper surface at a left end of the casing 70. A coil spring 53 fixed on the lower surface of the upper cover 50 urges this hook portion 71*c* in a direction to be apart from the upper cover 50, and the hook portion 71*c* comes into contact with a top panel 52*b* of the cover frame 52. The hook portion 71*c* at the left end is brought into contact with the top panel 51*b* of the cover frame 52 while the first front-held shaft 71*a* provided at the positioning reference position of the front plate in the optical writing unit 70 and the first rear-held shaft provided at the positioning reference position of the rear plate in the same pierce through the through openings of the cover frame 52, thereby holding the optical writing unit 70 in the cover frame 52. It is to be noted that a cover frame integrally molded with a main body of the upper cover 50 may be adopted as the cover frame 52.

The through opening 52*a* provided in the front plate of the cover frame 52 or the through opening provided in the rear plate has a size greatly larger than a diameter of the first front-held shaft 71*a* or the first rear-held shaft in the optical writing unit 70. The optical writing unit 70 is held in the cover frame 52 to allow its free movement within a range of a clearance between the through opening 52*a* in the front plate and the first front-held shaft 71*a* or a clearance between the through opening in the rear plate and the first rear-held shaft. In this printer, the cover frame 52 as a holder holds each held shaft to allow its free movement in a range of a clearance between the held shaft inserted into the through opening of the cover frame and an inner peripheral surface of the through opening in this manner.

Figure 7:
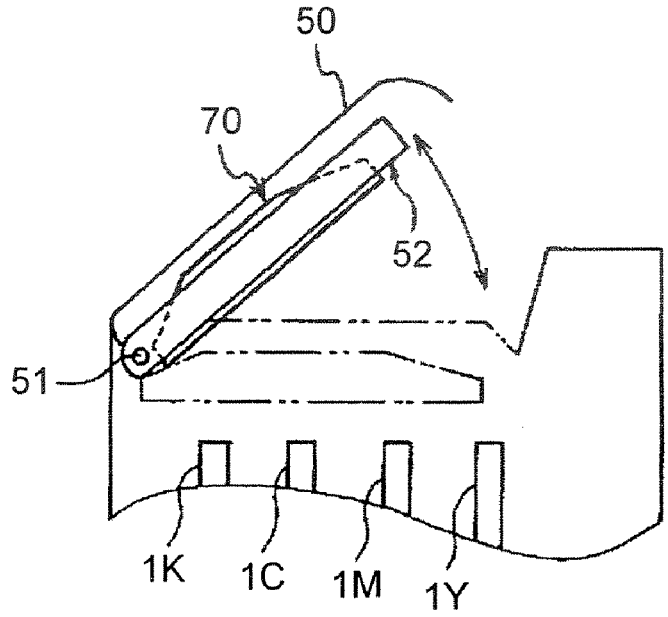
FIG. 7 is a schematic side view for explaining an opening/closing operation of the upper cover.

The upper cover 50 has each shaft hole 52*c* at a left end of the front plate or the rear plate 52*e* of the cover frame 52. On the other hand, in the housing of the printer, a front-side plate 80 is erected near the front surface thereof. Although not shown, a rear-side plate facing the front-side plate 80 with a predetermined distance therebetween on the rear side of this front-side plate 80 is also erected. Respective shaft holes (80*a* in case of the front-side plate 80) are provided near upper left corners of the front-side plate 80 and the rear-side plate. The left end of the cover frame 52 of the upper cover 50 is inserted between the front-side plate 80 and the rear-side plate, and the shaft member 51 is set to sequentially pierce through the shaft hole 80*a* in the front-side plate 80, the shaft hole 52*c* in the front plate of the cover frame 52, the shaft hole in the rear-side plate 80, and the shaft hole in the rear plate 52*e* of the cover frame 52 in this state. As a result, the upper cover 50, the cover frame 52, and the optical writing unit 70 are supported by the front-side plate 80 or the rear-side plate in the housing to swivel around the shaft member 51 as shown in FIG. 7. Then, the upper cover 50 moves between a first position at which it is completely closed with respect to the printer main body and a second position at which it is completely opened with respect to the printer main body based on its opening/closing operation. At this time, the optical writing unit 70 held in the cover frame 52 moves between a retracted position where it does not face all of the horizontally aligned process units 1Y, 1M, 1C, and 1K and a writing operation position where it faces each of these units with the opening/closing operation of the upper cover 50.

It is to be noted that a hook (not shown) is provided at each right end of the front plate or the rear plate 52*e* of the cover frame 52. When the upper cover 50 is closed, these hooks are engaged with respective extension pins (not shown) provided on the front-side plate 80 or the rear-side plate in the housing. A movement of the right end of the cover frame 52 is locked based on this engagement. The shaft member 51 restricts a movement of the left end of the cover frame 52.

As shown in FIG. 6, a first front urging coil spring 54 that urges the first front-held shaft 71*a* piercing through the through opening 52*a* in the cover frame 52 in an oblique direction from an upper left side toward a lower right side in the drawing is fixed on the front plate of the cover frame 52. Although the first front-held shaft 71*a* is depicted at a central position of the through opening 52*a* in the drawing, the first front-held shaft 71*a* urged by the first front urging coil spring 54 simultaneously comes into contact with a right wall and a bottom wall of an inner wall of the through opening 52*a* in the drawing when the upper cover 50 is opened. Although not shown, a first rear urging coil spring that urges the first rear-held shaft piercing through the through opening in the rear plate 52*e* of the cover frame 52 in an oblique direction from an upper left side toward a lower right side as seen from the front side of the apparatus main body is fixed on the rear plate 52*e* of the cover frame 52. When the upper cover 50 is opened, like the first front-held shaft 41*a*, the first rear-held shaft urged by the first rear urging coil spring simultaneously comes into contact with a right wall and a bottom wall of an inner wall of the through opening 52*a* in the rear plate. When the upper cover is opened, the first front-held shaft 71*a* simultaneously comes into contact with the right wall and the bottom wall as contact target portions in the inner wall of the through opening in the front plate of the cover frame 52, and the first rear-held shaft simultaneously comes into contact with the right wall and the bottom wall as contact target portions in the inner wall of the through opening in the rear plate 52*e* of the cover frame 52 in this manner. In this printer, when such contact is utilized to restrict a movement of the optical writing unit 70 held in the cover frame 52 to allow its free movement, the intensive backlash of the optical writing unit 70 due to the back action when moving the cover frame 52 as a holder together with the optical writing unit 70 at the time of the opening operation of the upper cover 50 can be avoided, thereby suppressing occurrence of a damage to the optical writing unit 70.

The first front-held shaft 71*a* or the first rear-held shaft as a held portion simultaneously comes into contact with not only one wall (one surface) of the inner wall in the through opening but also two walls (two surfaces), i.e., the right wall and the bottom wall as explained above. A direction of urging the first front-held shaft 71*a* or the first rear-held shaft by the first front urging coil spring 54 or the first rear urging coil spring is set to a direction along which the first front-held shaft 71*a* or the first rear-held shaft moves toward the two walls to realize such simultaneous contact. According to this structure, the first front-held shaft 71*a* or the first rear-held shaft is brought into contact with the two walls (the right wall and the bottom wall of the inner wall in the through opening) while being urged toward the two walls by the urging coil spring. As a result, a movement of the optical writing unit 70 in a free movement allowable range is completely restrained with a magnitude of the urging force of the urging coil spring being determined as a limit. The backlash of the optical writing unit 70 within the free movement allowable range when opening/closing the upper cover 50 can be avoided as long as an inertia force exceeding the urging force of the urging coil spring is not applied to the optical writing unit by, e.g., considerably roughly opening/closing the upper cover 50.

On the other hand, in a structure where the first front-held shaft 71*a* or the first rear-held shaft comes into contact with any one wall rather than the two walls, a movement of the optical writing unit 70 in the free movement allowable range cannot be completely restrained. For example, when the first front-held shaft 71*a* is configured to come into contact with the bottom wall alone in the through opening 52*a* in the front plate of the cover frame 52, the first front-held shaft 71*a* and the horizontal movement of the optical writing unit 70 in the free movement allowable range cannot be constrained. When the first front-held shaft 71*a* is configured to come into contact with the right side wall alone in the through opening 52*a*, the vertical movement of the optical writing unit 70 in the free movement allowable range cannot be restrained. As a result, when opening/closing the upper cover 50, the optical writing unit 70 may be jounced and damage the first front-held shaft 71*a* or the through opening 52*a*.

Figure 8:
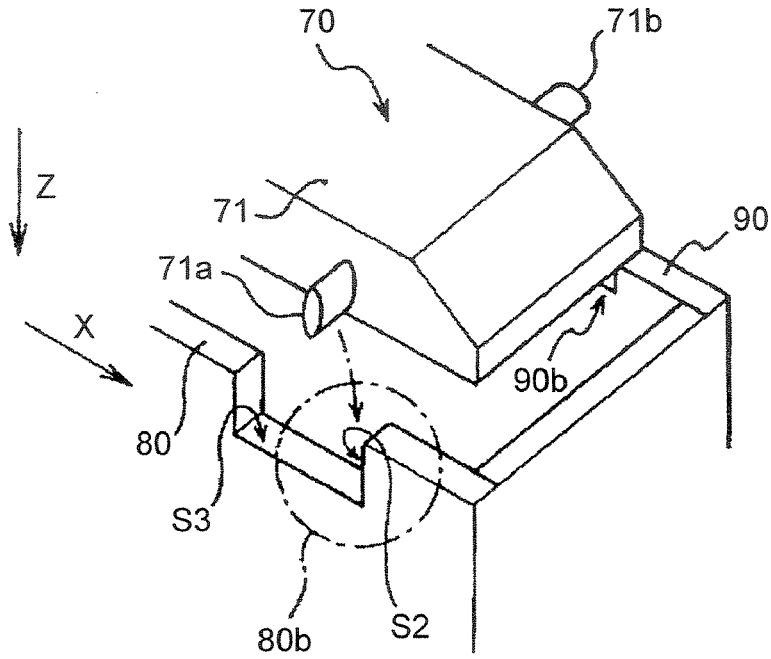
FIG. 8 is a perspective view of a right end of a housing of the printer.
Figure 9:
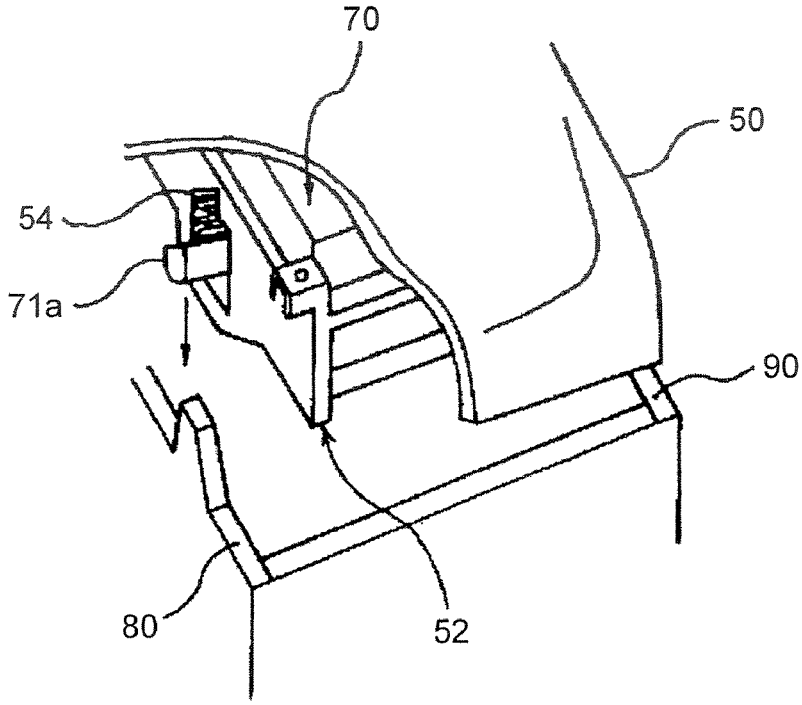
FIG. 9 is an exploded perspective view of the right end of the printer.

As shown in FIGS. 8 and 9, a front positioning portion 80*b* that is used to position the optical writing unit 70 placed at the writing operation position when the upper cover is closed is provided at an upper portion of the front-side plate 80 in the housing. This front positioning portion 80*b* has two contact surfaces that come into contact with the first front-held shaft 71*a* urged by the first front urging coil spring 54. The first contact surface is a second direction restricting contact surface S2 that restricts a movement of the first front-held shaft 71*a* in a direction indicated by an arrow X in the drawing. The direction indicated by the arrow X in the drawing is perpendicular to a front-and-back direction (a direction perpendicular to a page space in the drawing) as a latent image writing direction of the optical writing unit 70 (a main scanning direction), and the same as a lateral direction (a lateral direction in the drawing) as a moving direction at the latent image writing position (an optical writing position) on the surface of each photoconductor in the housing. The second contact surface is a third direction restricting contact surface S3 that restricts a movement of the first front-held shaft 71*a* in a direction indicated by an arrow Z in the drawing.

Figure 10:
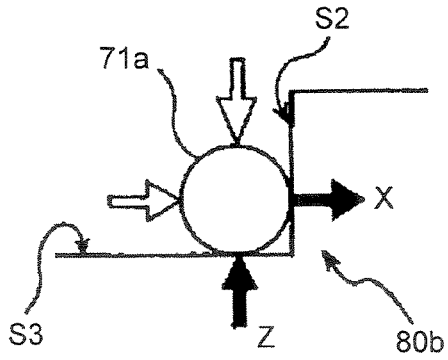
FIG. 10 is a schematic view of a state of contact between a first front-held shaft of an optical writing unit and a front positioning portion in the housing of the K process unit.

It is to be noted that the first front-held shaft 71*a* in the optical writing unit 70 moves to describe an arc around the shaft member 51 depicted in FIG. 7. However, when the first front-held shaft 71*a* comes into contact with the third direction restricting contact surface S3 of the front positioning portion 80*b* depicted in FIG. 8, it moves in the direction indicated by the arrow Z in the drawing as shown in FIG. 10. The direction indicated by the arrow X in the drawing is also a direction perpendicular to the latent image writing direction of the optical writing unit 70. In this printer, the direction indicated by the arrow X in the drawing is also a direction along which the four photoconductors are aligned.

Figure 11:
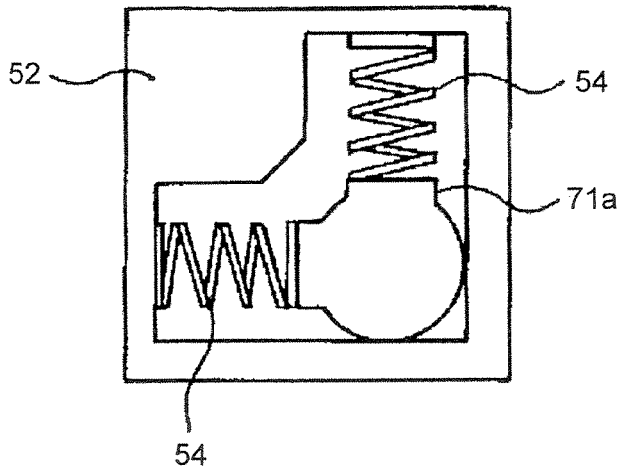
FIG. 11 is an enlarged front view of a front plate of a cover frame having two first urging coil springs provided thereon.

As the first front urging coil spring 54 that urges the first front-held shaft 71*a*, a coil spring that urges the first front-held shaft 71*a* in the X direction and a coils spring that urges the same in the Z direction may be separately provided as shown in white arrows. This is a structure depicted in FIG. 11. However, in this case, an increase in the number of coils raises a cost and a size of the apparatus. Like this printer having a structure shown in FIG. 12, when the first front urging coil spring 54 urges the first front-held shaft 71*a* to move in an oblique direction having a movement component in the X direction and a movement component in the Z direction, the cost and the size can be reduced. This is also true in the first rear urging coil spring that urges the first rear-held shaft.

Figure 12:
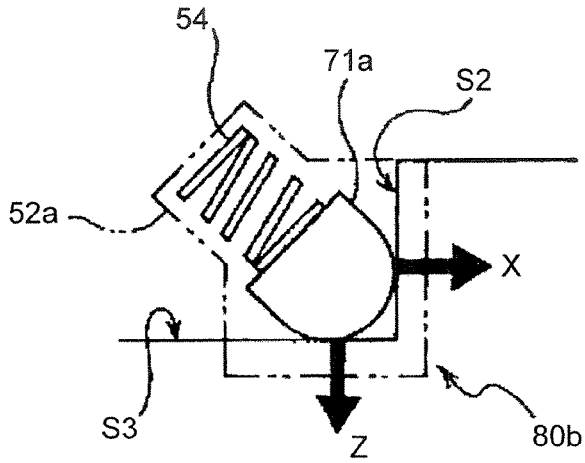
FIG. 12 is a perspective view of the first front-held shaft urged by the first urging coil springs and its peripheral structure.
Figure 13:
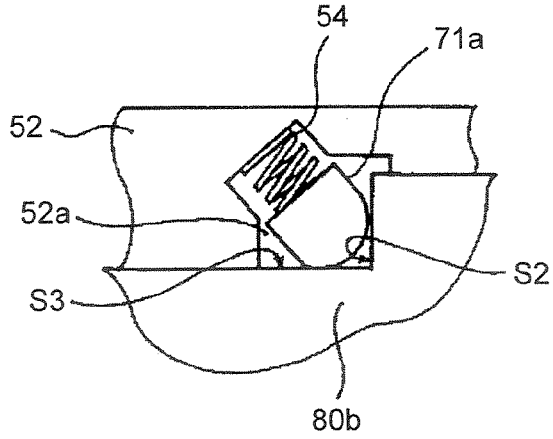
FIG. 13 is an enlarged front view of the front positioning portion and a front plate of the cover frame when the upper cover is closed.

A chain double-dashed line in FIG. 12 indicates the through opening provided in the cover frame. When the upper cover 50 is closed with respect to the printer main body, the right wall of the through opening 52*a* takes a posture to extend in the same direction as the second direction restricting contact surface S2 of the front positioning portion 80*b* of the front-side plate 80 (a posture to extend in the Z direction) as shown in the drawing. The right wall is placed apart from the first front-held shaft 71*a* as compared with the second direction restricting contact surface S2. In such a positional relationship, as shown in FIG. 13, the first front-held shaft 71*a* comes into contact with the second direction restricting contact surface S2 interposed between the side wall and the first front-held shaft 71*a*. When the upper cover is closed, the bottom wall of the through opening 52*a* takes a posture to extend in the same direction as the third direction restricting contact surface S3 of the front positioning portion 80*b* of the front-side plate 80 (a posture to extend in the X direction). The bottom wall is placed apart from the first front-held shaft 71*a* as compared with the third direction restricting contact surface S3. In such a positional relationship, the first front-held shaft 71*a* comes into contact with the third direction restricting contact surface S3 interposed between the bottom wall and the first front-held shaft 71*a*.

Figure 14:
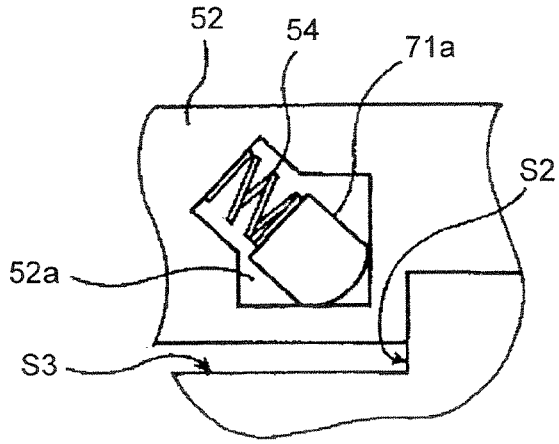
FIG. 14 is an enlarged front view of the front positioning portion and the front plate of the cover frame when the upper cover starts opening.

On the other hand, when the upper cover is opened, as shown in FIG. 14, the second direction restricting contact surface S2 or the third direction contact surface S3 of the front positioning portion 80*b* in the printer main body is separated from the first front-held shaft 71*a*. Then, the first front urging coil spring 54 urges the first front-held shaft 71*a* to allow its free movement in the through opening 52*a* in the cover frame 52, and the first front-held shaft 71*a* comes into contact with the right wall or the bottom wall of the through opening 52*a*. As a result, a backlash of the optical writing unit 70 is prevented Since the right wall and the bottom wall of the through opening 52*a* and the second direction restricting contact surface S2 and the third direction restricting contact surface in the front positioning portion 80*b* of the front-side plate in the printer have substantially the same shape, the single first front urging coil spring 54 can serve as both an urging unit that brings the first front-held shaft 71*a* into contact with the bottom wall or the right wall of the through opening 52*a* and an urging unit that brings the first front-held shaft 71*a* into contact with the second direction restricting contact surface S2 or the third direction restricting contact surface S3. This can be also applied to the rear end of the printer.

As explained above, when the upper cover 50 is opened, the first front urging coil spring 54 and the first rear urging coil spring fixed in the through openings in the cover frame 52 urge the first front-held shaft 71*a* and the first rear-held shaft toward the right walls and the bottom walls of the through openings to come into contact, thereby constraining a movement of the optical writing unit 70 in the free movement allowable range. On the other hand, when the upper cover 50 is opened, the first front urging coil spring 54 and the first rear urging coil spring urge the first front-held shaft 71*a* and the first rear-held shaft toward the second direction restricting contact surface S2 and the third direction restricting contact surface S3 to come into contact, thereby positioning the optical writing unit 70 in both the X and the Z directions. According to such a structure, the first front urging coil spring 54 and the first rear urging coil spring function as both an urging unit that constrains a movement of the optical writing unit 70 in the free movement allowable range when the upper cover is opened and an urging unit that positions the optical writing unit 70 when the upper cover is closed, respectively.

Figure 15:
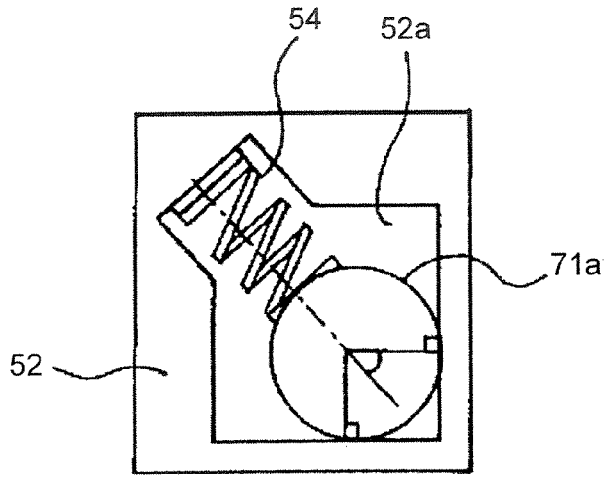
FIG. 15 is an enlarged front view of a through opening of the cover frame.

In this printer, the through opening 52*a* is formed in such a manner that the right wall and the bottom wall of the inner wall of the through opening 52*a* in the front plate of the cover frame 52 take postures to extend in directions perpendicular to each other. As shown in FIG. 15, an inclination θ as an angle formed between an orthogonal line with respect to the right wall of the inner wall of the through opening 52*a* and a coil axis line direction that is an urging direction of the first front urging coil spring 54 is set to 45[°]. This inclination θ does not necessarily have to be 45[°], and it can be set within a range of "$0° < \theta < 90°$". For example, in a state where the upper cover is opened and vertically erected, a substantially all amount of a load of the optical writing unit 70 acts in a direction along the bottom wall surface of the through opening 52*a*. Therefore, the first front-held shaft 71*a* may be possibly jounced in a direction of the bottom wall surface in the through opening 52*a* depending on the load of the optical writing unit 70. In such a case, it is good enough to set the inclination θ to be smaller than 45[°] and strongly bring the first front-held shaft 71*a* into contact with the right wall rather than the bottom wall of the through opening.

The first front urging coil spring 54 depicted in FIG. 6 urges the first front-held shaft 71*a* in the optical writing unit 70 placed at the writing opening position when the upper cover 50 is closed, thereby bringing the first front-held shaft 71*a* into contact with both the second direction restricting contact surface S2 and the third direction restricting contact surface S3 of the front positioning portion 80*b* depicted in FIG. 8. As a result, the front end of the optical writing unit 70 placed at the writing operation position is positioned in the X direction and also positioned in the Z direction.

A rear positioning portion 90*b* that is used to position the optical writing unit 70 placed at the writing operation position when the upper cover is closed is provided at the upper portion of the rear-side plate 90 arranged behind the front-side plate 80. This rear positioning portion 90*b* has two contact surfaces that come into contact with the first rear-held shaft 71*b* urged by the first rear urging coil spring. The first contact surface is a second direction restricting contact surface that restricts a movement of the first rear-held shaft 71*b* in the direction indicated by the arrow X in the drawing. The second contact surface is a third direction restricting contact surface that restricts a movement of the first rear-held shaft 71*b* in the direction indicated by the arrow Z in the drawing.

The first rear urging coil spring fixed on the rear plate 52*e* of the cover frame 52 urges the first rear-held shaft 71*b* of the optical writing unit 70 placed at the writing operation position to bring this shaft into contact with both the second direction restricting contact surface and the third direction restricting contact surface of the rear positioning portion 90 as shown in FIG. 8. As a result, the rear end of the optical writing unit 70 placed at the writing operation position is positioned in the X direction and also positioned in the Z direction.

In the printer having this structure, when the optical writing unit 70 is moved from the writing operation position to the retracted position as required based on rotation of the upper cover 50, the optical writing unit 70 is greatly separated from the respective process units 1Y, 1M, 1C, and 1K that include the photoconductors or their peripheral devices. This separating movement allows the respective process units 1Y, 1M, 1C, and 1K to be exposed, thereby improving maintenance properties for these units.

When the held shaft of the optical writing unit 70 placed at the writing operation position comes into contact with the positioning portion in the housing based on the urging force of the coil spring, the optical writing unit 70 is positioned with respect to each photoconductor in the housing. Therefore, even if the cover frame 52 as a holder, which moves while movably holding the optical writing unit 70, moves with a backlash to some extent, the optical writing unit 70 can be positioned with respect to each photoconductor in the housing at the writing operation position, thus suppressing a reduction in the writing position accuracy of the optical writing unit 70.

The first front-held shaft 71*a* is provided at one end (the front end) of the optical writing unit 70 in the latent image writing direction (the front-and-back direction), and the first rear-held shaft 71*b* is provided at the other end (the rear end) of the same. When these shafts respectively come into contact with the second direction restricting contact surface S2 at both ends, the following operation can be realized. That is, both ends of the optical writing unit 70 in the latent image writing direction are positioned in the direction indicated by the arrow X in the drawing that is perpendicular to the latent image writing direction and the same as the moving direction at the optical writing position on the surface of each photoconductor. As a result, the latent image writing direction with respect to the photoconductor surface can be accurately positioned with respect to the direction perpendicular to the moving direction on the surface to suppress a skew in the latent image writing direction on the photoconductor surface (an inclination from the direction perpendicular to the moving direction on the surface), thereby constraining the skew of an image on a paper surface.

The direction indicated by the arrow X in the drawing is also the direction along which the respective photoconductors (2Y to K) are aligned, and hence a skew in the latent image writing direction can be suppressed on the surface of each photoconductor. As a result, displacement of a relative position of respective color toner images and superimposition displacement (color shift) can be suppressed.

When both ends of the optical writing unit 70 in the latent image writing direction come into contact with the third direction restricting contact surface S3 to perform positioning in the moving direction, the optical writing unit 70 can be prevented from inclining from one end side toward the other end side.

In this printer, as explained above, the optical writing unit 70 can be positioned in all of the X direction, the Y direction, and the Z direction perpendicular to one another, thus maintaining the very high writing position accuracy.

In regard to the first front urging coil spring 54, it is desirable to set an urging force or an urging direction so that this coil spring has a conditional expression "F cos $\theta_2$>μ×(a unit load proportional distribution W1×a gravitational acceleration G+F sin $\theta_2$)". Here, F means an urging force [N] of the first front urging coil spring 54. $\theta_2$ is an angle formed between an urging direction (a coil axis line direction) of the first front urging coil spring 54 and the third direction restricting contact surface (S3 in FIG. 12) when the upper cover 50 is closed. In this printer, since the third direction restricting contact surface S3 extends in the horizontal direction, this angle corresponds to an inclination of the urging direction of the first front urging coil spring 54 from the horizontal direction. The unit load proportional distribution W1 [kg] means a load applied to the first front-held shaft 71*a* in an overall weight of the optical writing unit 70 when the upper cover 50 is closed to bring the first front-held shaft 71*a* into contact with the third direction restricting contact surface S3. In this printer, when the upper cover 50 is closed, both the first front-held shaft 71*a* and the first rear-held shaft support the optical writing unit 70, and a load distribution in the front-and-back direction of the unit is uniform. Therefore, the unit load proportional distribution W1 is ½ of the overall weight of the optical writing unit 70. The gravitational accelerator G is 9.8 [m/sec$^2$].

The conditional expression "F cos $\theta_2$>μ×(the unit load proportional distribution W1×the gravitational acceleration G+F sin $\theta_2$)" is provided for the following reason. That is, when the upper cover 50 is closed, as shown in FIG. 12, almost all of the load of the optical writing unit 70 is applied to the third direction restricting contact surface S3 via the first front-held shaft 71*a*. At this moment, the first front-held shaft 71*a* may not be possibly excellently slid on the third direction restricting contact surface S3 by using the urging force of the first front urging coil spring 54 depending on a frictional force between the first front-held shaft 71*a* and the third direction restricting contact surface S3. As shown in FIG. 15, when the urging force (hereinafter, "spring urging force") in the coil axis line direction provided by the first front urging coil spring 54 is divided into a horizontal component force F1 and a vertical component force F2, the horizontal component force F1=F cos θ and the vertical component force F2=F sin θ can be achieved. A relationship "the horizontal component force F1>a static frictional force f", i.e., "F cos θ>the static frictional force f" must be provided to assuredly move the optical writing unit 70 in the horizontal direction against the static frictional force f between the third direction restricting contact surface S3 and the first front-held shaft 71*a*. When the first front urging coil spring 54 is not provided, "the static frictional force f=a static friction coefficient μ×the unit load proportional distribution W1×the gravitational acceleration G" is attained. However, when the first front urging coil spring 54 is provided, not only the unit load proportional distribution W1 but also the vertical component force F2 of the spring contribute to the static frictional force f, thus achieving "the static frictional force f=μ×(the unit load proportional distribution W1×the gravitational acceleration G+F sin θ)". Therefore, the conditional expression "F cos θ<μ×(the unit load proportional distribution W1×the gravitational acceleration G+F sin θ)" must be provided to horizontally move the optical writing unit 70 against the frictional force between the first front-held shaft 71*a* and the third direction restricting contact surface S3. It is to be noted that this can be also applied to the first rear urging coil spring 57.

Figure 16:
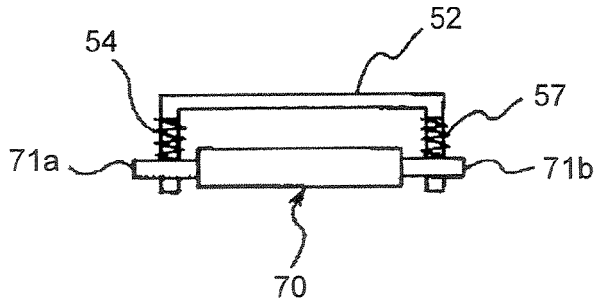
FIG. 16 is a lateral cross-sectional view of the cover frame and the optical writing unit.
Figure 17:
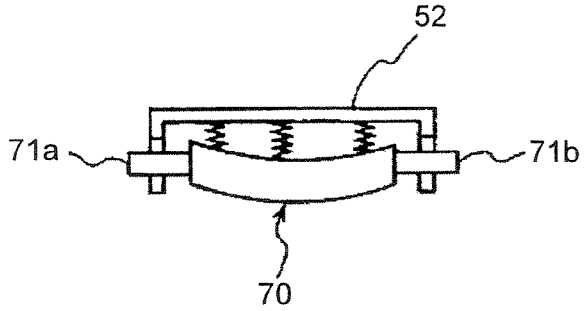
FIG. 17 is a lateral cross-sectional view of the cover frame and the optical writing unit in a comparative example in which a center of the optical writing unit in a front-and-back direction is urged.

FIG. 16 is a lateral cross-sectional view of the cover frame 52 and the optical writing unit 70. As shown in this drawing, the first front urging coil spring 54 urges the first front-held shaft 71*a* at the front end of the optical writing unit 70, and the first rear urging coil spring 57 urges the first rear-held shaft 71*b* at the rear end of the same. When the entire optical writing unit 70 is urged based on the urged state of the first front-held shaft 71*a* at the front end or the first rear-held shaft 71*b* at the rear end, bending of the optical writing unit 70 involved by urging can be avoided. On the other hand, as shown in FIG. 17, the urging coil spring urges the center of the optical writing unit 70 in the front-and-back direction in place of the held shafts, the center of the optical writing unit 70 is greatly bent in the urging direction with the first front-held shaft 71*a* and the first rear-held shaft 71*b* being used as supporting points. This bending deteriorates the optical writing accuracy. In particular, occurrence of an abnormal image due to displacement of a reflecting mirror or a lens is concerned.

Figure 18:
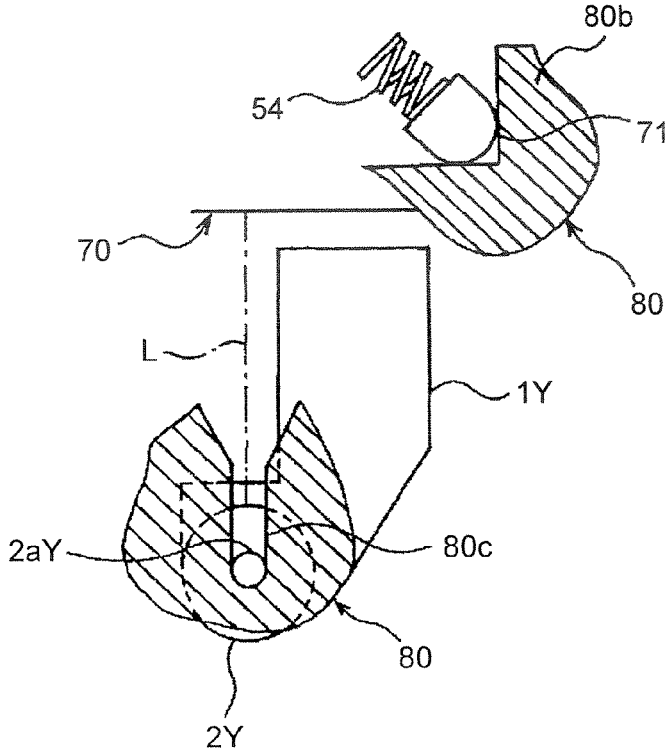
FIG. 18 is an enlarged view of a Y process unit and its peripheral structure of the printer as seen from a front side of the printer.

FIG. 18 is an enlarged view of the Y process unit 1Y and its peripheral structure as seen from the front side of the printer. A slit 80*c* extending downwards from the upper side in the vertical direction is provided in the front-side plate 80 in the housing. When a front drum shaft 2*a*Y at the front end of the photoconductor 2Y in the Y process unit 1Y is inserted into this slit 80*c*, the front end of the process unit 1Y is supported by the front-side plate 80 to be slidable in the vertical direction (the Z direction) with respect to the front-side plate. Although not shown, the rear-side plate in the housing also slidably supports the rear end of the process unit 1Y based on the same structure. As a result, the process unit 1Y is attachable/detachable in the vertical direction with respect to the inside of the housing. Although not shown, the front-side plate 80 or the rear-side plate has other three slits that slidably support the process units for the other colors (M, C, and K). Therefore, the front-side plate 80 or the rear-side plate functions as a support that supports the photoconductor to be slidable in the attaching/detaching direction. The slits provided in these side plates function as a latent image carrier positioning portion that positions the drum shaft as a positioning reference portion of each photoconductor.

Figure 19:
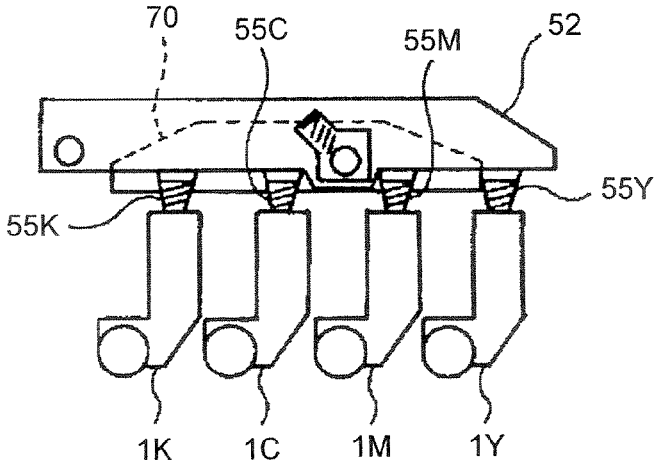
FIG. 19 is a front view of optical writing units, the cover frame, and four process units of the printer.
Figure 20:
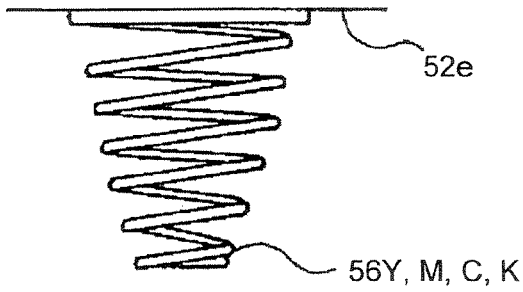
FIG. 20 is an enlarged view of the cover frame and a process-unit urging spring.

FIG. 19 is a front view of the optical writing unit 70 as well as the cover frame 52, and the four process units 1Y, 1M, 1C, and 1K. Although not shown in FIG. 6 for the convenience's sake, four process-unit urging springs 55Y, 55M, 55C, and 55K for Y, M, C, and K that are aligned at intervals are fixed on the lower surface of the front plate of the cover frame 52. Although not shown in FIG. 19, the similar four process-unit urging springs 56Y, 56M, 56C, and 56K are likewise fixed on the lower surface of the rear plate 52*e* of the cover frame 52 as depicted in FIG. 20. When the upper cover is closed, these process-unit urging springs come into contact with the upper surfaces of the process units 1Y, 1M, 1C, and 1K to urge these units downwards in the vertical direction (the Z direction). Based on this urging operation, the front drum shaft 2*a*Y of the photoconductor 2Y or the rear drum shaft comes into contact with the bottom surface in the slit of the side plate, whereby the photoconductor 2Y is positioned in the Z direction. The photoconductors for the other colors are likewise positioned in the Z direction.

These process-unit urging springs as the second urging units may be provided in the housing. However, in this case, the process-unit urging springs obstruct attachment/detachment of the process units, and hence the springs must be attachably/detachably provided. A troublesome operation of attaching/detaching each process-unit urging spring must be carried out every time each process unit is attached/detached. On the other hand, like this printer, when the process-unit urging springs are fixed on the cover frame 52, these springs do not obstruct attachment/detachment of the process units, thereby omitting such a troublesome operation.

Figure 21:
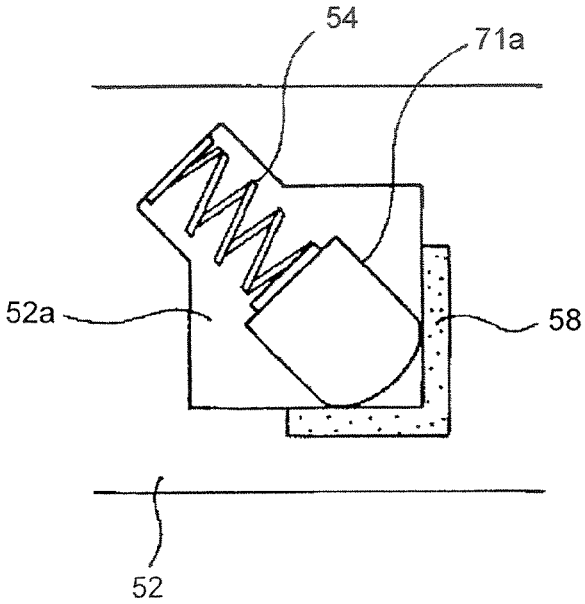
FIG. 21 is a front view of a front plate of a cover frame in an apparatus according to a first modification.

FIG. 21 is an enlarged front view of the front plate of the cover frame 52 in an apparatus according to a first modification of this printer. In this apparatus according to the first modification, the bottom wall or the right wall of the through opening 52*a* in the cover frame 51 is formed of a buffer member 58 including a compressible/deformable material. As the compressible/deformable material, there are an elastic rubber, an elastic resin, urethane foam, and others. According to this structure, even if the first front-held shaft 71*a* collides with the right wall or the bottom wall of the through opening 52*a* with a great force, the buffer member 58 including the compressible/deformable material is compressed and deformed to alleviate this impact. As a result, occurrence of a failure in various devices in the optical writing unit 70 or the printer main body due to an impact can be reduced. Although provision of the buffer member 58 slightly lowers the positioning accuracy of the optical writing unit 70 when the upper cover is opened, the positioning accuracy required when the cover is opened is lower than that when the cover is closed. Therefore, no problem occurs. As the buffer member 58, it is good enough to use a member having a repulsive force (a degree of hardness, a thickness) weaker than the urging force of the first front urging coil spring 54. For reducing the friction coefficient between the bottom wall or the right wall of the through opening 52*a* and the first front-held shaft 71*a*, using the buffer member 58 superior in surface smoothness is desirable.

Figure 22:
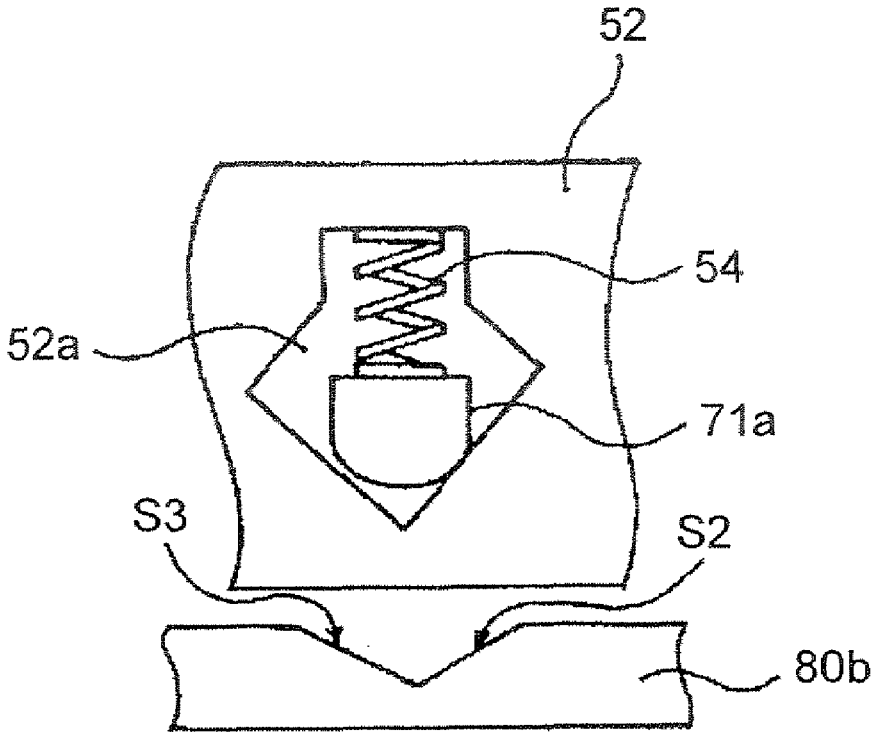
FIG. 22 is an enlarged front view of a cover frame and a front positioning portion in an apparatus according to a second modification.
Figure 23:
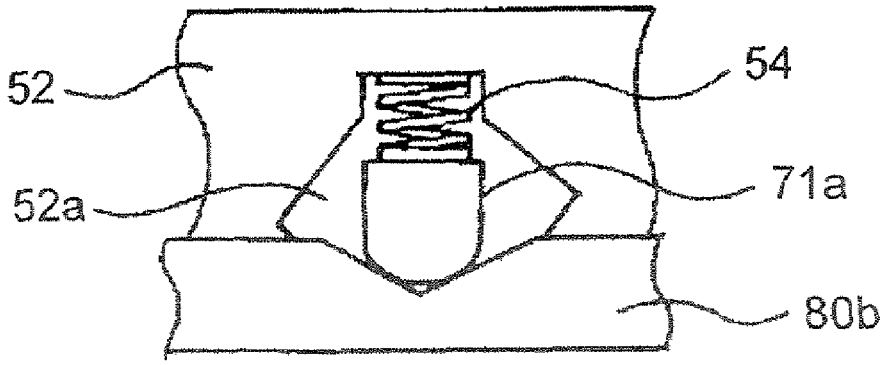
FIG. 23 is an enlarged front view of the front positioning section and the front plate of the cover frame when an upper cover starts opening.

FIG. 22 is an enlarged front view of the front plate of the cover frame 52 and the front positioning portion 80*b* in an apparatus of a second modification of the printer according to this embodiment. In this apparatus according to the second modification, a contact surface inclined from the Z direction is provided as the second direction restricting contact surface S2 of the front positioning portion 80*b*. A contact surface inclined from the X direction is provided as the third direction restricting contact surface of the front positioning portion 80*b*. As shown in FIG. 23, a structure in which an opening wall serving as a contact target portion when the upper cover is closed extends in the same direction as the second direction restricting contact surface S2 or the third direction restricting contact surface S3 is provided as the through opening 52*a* in the cover frame 52. When the upper cover is closed, an axis line direction of the first front urging coil spring 54 becomes substantially parallel with the vertical direction.

The example of the printer adopting a one-component developing mode of developing a latent image by using a one-component developer mainly containing a toner without a magnetic carrier is explained above. However, the present invention can be likewise applied to an image forming apparatus adopting a two-component developing mode of using a two-component developer containing the magnetic carrier and the toner.

The example of the printer having the structure in which the optical writing unit 70 is moved with an opening/closing operation of the upper cover 50 is explained above. However, the present invention can be also applied to an image forming apparatus in which the optical writing unit 70 is solely swiveled to be retracted from the position facing each of the four process units. The present invention can be likewise applied to an image forming apparatus having a structure that the optical writing unit 70 is slid without swiveling.

In the printer according to this embodiment, the first front-held shaft 71*a* or the first rear-held shaft 71*b* as a held portion is provided at the positioning reference position of the optical writing unit 70 as the latent-image writing unit. The front positioning portion 80*b* or the rear positioning portion that is used to position the optical writing unit 70 placed at the writing operation position when the upper cover 50 is closed is provided in the printer. The first front-held shaft 71*a* or the first rear-held shaft 71*b* urged by the first front urging coil spring 54 or the first rear urging coil spring 57 at the writing operation position comes into contact with the front positioning portion 80*b* or the rear positioning portion. In this structure, when the upper cover 50 is closed, the first front-held shaft 71*a* or the first rear-held shaft 71*b* comes into contact with the front positioning portion 80*b* or the rear positioning portion, thereby positioning the optical writing unit 70.

In the printer according to this embodiment, the front positioning portion 80*b* or the rear positioning portion is placed close to the first front urging coil spring 54 or the first rear urging coil spring of the cover frame 52 as the holder placed at the first position when the upper cover is opened rather than the through opening inner wall as the contact target portion of the cover frame 52. In this structure, when the upper cover 50 is closed, the first front urging coil spring 54 or the first rear urging coil spring 57 urges the first front-held shaft 71*a* or the first rear-held shaft 71*b* toward the front positioning portion 80*b* or the rear positioning portion to come into contact as explained above. As a result, the single first front urging coil spring 54 and the single first rear urging coil spring 57 can serve as both the urging unit that brings the first front urging coil spring 54 and the first rear urging coil spring 57 into contact with the bottom wall or the right wall in the through opening of each of the first front-held shaft 71*a* and the first rear-held shaft 71*b* and the urging unit that brings the first front-held shaft 71*a* and the first rear-held shaft 71*b* into contact with the front positioning portion 80*b* and the rear positioning portion.

In the printer according to this embodiment, the front positioning portion 80*b* and the rear positioning portion are arranged on extensions of the urging directions (the axis line directions) of the first front urging coil spring 54 and the first rear urging coil spring 57 in the cover frame 52 placed at the first position when the upper cover 50 is opened. According to this structure, when the first front-held shaft 71*a* and the first rear-held shaft 71*b* come into contact with the front positioning portion 80*b* and the rear positioning portion on the extensions of the urging directions, buckling of the first front urging coil spring 54 and the first rear urging coil spring 57 can be avoided to bring each held shaft into contact with each positioning portion with a secure force.

In the printer according to this embodiment, a wall formed of the buffer member 58 that is compressed and deformed in response to contact of the first front-held shaft 71*a* is used as the bottom wall or the right wall of the through opening 52*a* as the contact target portion. Therefore, occurrence of a failure in various devices in the optical writing unit 70 or the printer due to an impact when the upper cover is closed with a great force can be suppressed for this reason.

In the printer according to this embodiment, as the front-side plate 80 or the rear-side plate 90 serving as a support that supports the optical writing unit 70 in the main body, a structure having a slit as a guiding section that guides each photoconductor from the operating position toward the writing operation position of the optical writing unit 70 is used. Each photoconductor is slid in the slit to be attached to/detached from the front-side plate 80 or the rear-side plate 90. As the cover frame 52, the present invention adopts a structure having the process-unit urging springs 55Y, 55M, 55C, and 55K as the second urging units that urge each process unit casing including the photoconductor toward the operating position of the photoconductor in the first position when the upper cover 50 is opened. According to this structure, each photoconductor can be readily attached/detached by a sliding movement, and positioned in the Z direction as the attaching/detaching direction.

In the printer according to this embodiment, the bottom wall and the right wall extending in different directions are provided in the through opening as the contact target portion. Therefore, the first front-held shaft 71*a* and the first rear-held shaft 71*b* urged by the first front urging coil spring 54 and the first rear urging coil spring 57 simultaneously come into contact with these walls as the contact surfaces. According to this structure, the first front-held shaft 71*a* or the first rear-held shaft 71*b* can be prevented from jouncing in the free movement allowable range when the upper cover 50 is opened.

In the printer according to this embodiment, the first front urging coil spring 54 and the first rear urging coil spring 57 urge the first front-held shaft 71*a* and the first rear-held shaft 71*b* in the optical writing unit 70. According to this structure, bending of the optical writing unit 70 due to urging by each urging coil spring can be avoided as explained in conjunction with FIGS. 16 and 17.

In the printer according to this embodiment, the cover frame 52 holds the first front-held shaft 71*a* and the first rear-held shaft 71*b* to allow their free movements in a range of a clearance between the first front-held shaft 71*a* and the first rear-held shaft 71*b* that are inserted into the through openings formed in the cover frame 52 and the inner peripheral surfaces of the through openings. Of a plurality of wall surfaces constituting the inner wall of each through opening as the contact target portion, at least the bottom wall surface and the right wall surface are the contact surfaces coming into contact with the held shafts. Another wall surface is an urging unit fixing surface on which the first front urging coil spring 54 or the first rear urging coil spring is fixed. According to this structure, when each urging coil spring is accommodated in each through opening, a size of the apparatus can be reduced.

In the printer according to this embodiment, the optical writing unit 70 that writes a latent image on each photoconductor based on optical scanning is used as the latent-image writing unit. The respective held portions (the first front-held shaft 71*a* and the first rear-held shaft 71*b*) are provided at the front end as one end and the rear end as the other end in the optical scanning direction. The through openings as the contact target portions are provided at the front end and the rear end of the cover frame 52 in the optical scanning direction, respectively. According to this structure, the latent image writing direction with respect to the photoconductor surface is accurately positioned in a direction perpendicular to the moving direction on the photoconductor surface to suppress a skew on the photoconductor surface in the latent image writing direction. As a result, a skew of an image on a paper surface can be restrained. Suppressing a skew on the surface of each photoconductor in the latent image writing direction can restrain relative displacement of a toner image having each color and superimposition displacement (color shift).

According to an aspect of the present invention, when the latent-image writing unit is moved from the operating position to the retracted position as required, the latent-image writing unit is separated from the latent image carrier or its peripheral device. The latent image carrier or the peripheral device can be exposed by this separating operation, thereby improving maintenance properties of these members.

According to another aspect of the present invention, when the urging unit urges the latent-image writing unit held to allow its free movement by the holder, the latent-image writing unit can come into contact with the positioning portion in the image forming apparatus main body to be positioned.

According to another aspect of the present invention, the held portion of the latent-image writing unit urged by the urging unit comes into contact with the contact target portion of the holder that moves together with the latent-image writing unit when separated from the writing operation position to constrain a movement of the latent-image writing unit on the holder. As a result, an intensive backlash of the latent-image writing unit due to a back action when moving the holder together with the latent-image writing unit can be avoided, thus suppressing occurrence of damage to the latent-image writing unit.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier that carries a latent image on an endlessly moving surface;

a latent-image writing unit that writes the latent image on the surface;

a holder that moves between a first position and a second position while holding the latent-image writing unit to move the latent-image writing unit held by itself between a writing operation position and a retracted position; and a developing unit that develops the latent image carried by the latent image carrier, wherein the holder holds a held portion provided in the latent-image writing unit to allow a free movement thereof and urges the latent-image writing unit in a predetermined direction by an urging unit, thereby bringing the held portion in the latent-image writing unit into contact with a contact target portion of the holder when separated from the writing operation position, the predetermined direction including a substantial horizontal component and a substantial vertical component when the held portion contacts the contact target portion.

2. The image forming apparatus according to claim 1, wherein the held portion is provided at a positioning reference position of the latent-image writing unit to be determined as a positioning reference region, a positioning portion that is used to position the positioning reference region of the latent-image writing unit placed at the writing operation position is provided in the image forming apparatus, and the positioning reference region of the latent-image writing unit urged by the urging unit at the writing operation position comes into contact with the positioning portion.

3. The image forming apparatus according to claim 2, wherein the positioning portion rather than the contact target portion is placed near the urging unit of the holder present at the first position in an urging direction.

4. The image forming apparatus according to claim 2, wherein the positioning portion in the image forming apparatus is arranged on an extension of the urging unit in an urging direction in the holder placed at the first position.

5. The image forming apparatus according to claim 1, wherein the contact target portion is formed of a material that is compressed and deformed with contact of the held portion.

6. The image forming apparatus according to claim 1, wherein the carrier that carries the latent image carrier includes a guiding unit that guides the latent image carrier from an operating position of the latent image carrier toward the write operating position of the latent-image writing unit, the latent image carrier is slid in the guiding unit to be attached/detached with respect to the holder, and the holder has a second urging unit that urges the latent image carrier or a casing including the latent image carrier toward the operating position of the latent image carrier at the first position.

7. The image forming apparatus according to claim 1, wherein a plurality of contact surfaces extending in different directions are provided on the contact target portion, and the held portion urged by the urging unit comes into contact with the contact surfaces at the same time.

8. The image forming apparatus according to claim 7, wherein the urging unit urges the held portion of the latent-image writing unit.

9. The image forming apparatus according to claim 8, wherein the holder holds the held portion to allow a free movement thereof in a range of a clearance between the held portion inserted into a through opening formed therein and an inner peripheral surface of the through opening, the contact surfaces of the contact target portion are at least two of a plurality of surfaces constituting the inner peripheral surface, and at least another surface of the surfaces is an urging unit fixing surface on which the urging unit is fixed.

10. The image forming apparatus according to claim 1, wherein the latent-image writing unit writes the latent image on the latent image carrier based on optical scanning, the held portion is provided at each of one end and the other end of the latent-image writing unit in an optical scanning direction, and the contact target portion is provided at each of one end and the other end of the holder in the optical scanning direction.

11. A moving unit for use in an image forming apparatus, the moving unit comprising:

a latent image carrier that carries a latent image on an endlessly moving surface;

a latent-image writing unit that writes the latent image on the surface; and a holder that moves between a first position and a second position while holding the latent-image writing unit to move the latent-image writing unit held by itself between a writing operation position and a retracted position, wherein the holder holds a held portion provided in the latent-image writing unit to allow a free movement thereof and urges the latent-image writing unit in a predetermined direction by an urging unit, thereby bringing the held portion in the latent-image writing unit into contact with a contact target portion of the holder when separated from the writing operation position, the predetermined direction including a substantial horizontal component and a substantial vertical component when the held portion contacts the contact target portion.

* * * * *